US005342226A

United States Patent [19]

Hayes et al.

[11] Patent Number: 5,342,226

[45] Date of Patent: Aug. 30, 1994

[54] FEMALE BLADE TERMINAL

[75] Inventors: Earl J. Hayes, Northville; Christopher J. Volpe, Ferndale, both of Mich.

[73] Assignee: Electro-Wire Products, Inc., Troy, Mich.

[21] Appl. No.: 78,639

[22] Filed: Jun. 21, 1993

[51] Int. Cl.[5] ..... H01R 13/11

[52] U.S. Cl. ..... 439/845; 439/850

[58] Field of Search ..... 439/845, 849, 850, 851, 439/856, 857, 891

[56] References Cited

U.S. PATENT DOCUMENTS

| | | | |
|---|---|---|---|
| 2,701,350 | 2/1955 | Soreng | 439/849 |
| 3,170,752 | 2/1965 | Van Horssen | 439/891 |
| 3,188,606 | 6/1965 | DeLyon et al. | 439/850 |
| 3,412,369 | 11/1968 | Fox | 439/857 |
| 3,550,067 | 12/1970 | Hansen | 439/850 |
| 3,559,604 | 2/1971 | Ruehleman et al. | 113/119 |
| 3,564,487 | 2/1971 | Upstone et al. | 439/891 |
| 3,663,931 | 5/1972 | Brown | 439/885 |
| 3,673,551 | 6/1972 | McDonough | 439/885 |
| 3,675,320 | 7/1972 | Watanabe | 29/630 D |
| 3,758,944 | 9/1973 | Berg | 29/630 |
| 3,850,500 | 11/1974 | Cobaugh et al. | 439/857 |
| 4,040,177 | 8/1977 | Beeler et al. | 29/630 C |
| 4,692,121 | 9/1987 | Arbogast, Jr. | 439/874 |
| 4,718,866 | 1/1988 | Yamaguchi | 439/607 |
| 4,720,276 | 1/1988 | Takahashi | 439/861 |
| 4,825,541 | 5/1989 | Czeschka et al. | 29/885 |
| 4,874,338 | 10/1989 | Bakermans | 439/851 |
| 4,934,965 | 6/1990 | Buddrus et al. | 439/845 |
| 4,957,451 | 9/1990 | Nadin | 439/395 |
| 5,098,320 | 3/1992 | Colleran | 439/876 |

FOREIGN PATENT DOCUMENTS

| | | | |
|---|---|---|---|
| 2506796 | 9/1975 | Fed. Rep. of Germany | 439/857 |

*Primary Examiner*—Gary F. Paumen

*Attorney, Agent, or Firm*—Krass & Young

[57] ABSTRACT

A female blade terminal assembly including a female blade terminal having a cage structure adapted to receive a male blade terminal and a shroud of seamless tubular cross sectional configuration adapted to fit over the cage structure in surrounding relation to the beam portions of the cage structure. The female blade terminal is formed from a single piece of conductive sheet material of a given thickness and the beam portions have a thickness less than the given thickness. The cage portion further includes front and rear annular collar portions of the given thickness with the reduced thickness beam portions extending between the annular collar portions. The shroud precludes outward splaying of the cage structure in response to insertion of the male blade terminal, limits the outward deflection of the beam portions to preclude plastic deformation of the beam portions, and precludes the entry of contaminants into the electrical interface between the beam portions and the male blade terminal. A method of forming the female blade terminal assembly is also disclosed.

15 Claims, 4 Drawing Sheets 10
12
5
5
16

10
14d
14e
14i
14p
14m
14b
14u
14v
14f
14k
14j
14a
14c
3
3
12

12
12a
12b
12c
12d

FIG-4
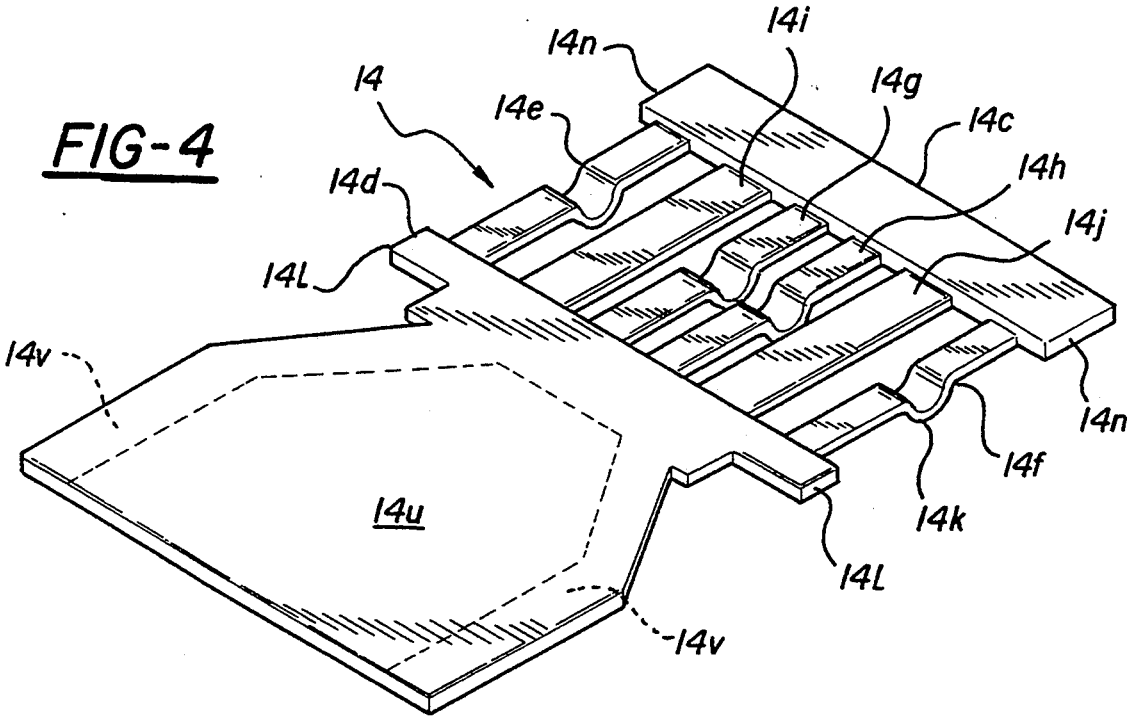
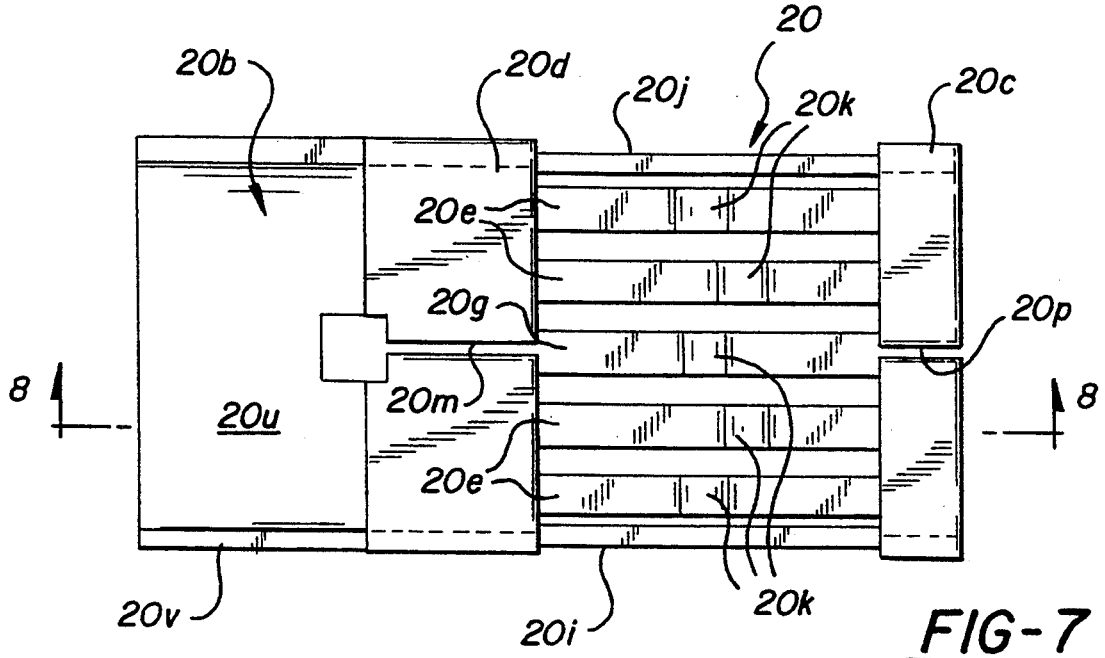
FIG-7
FIG-8
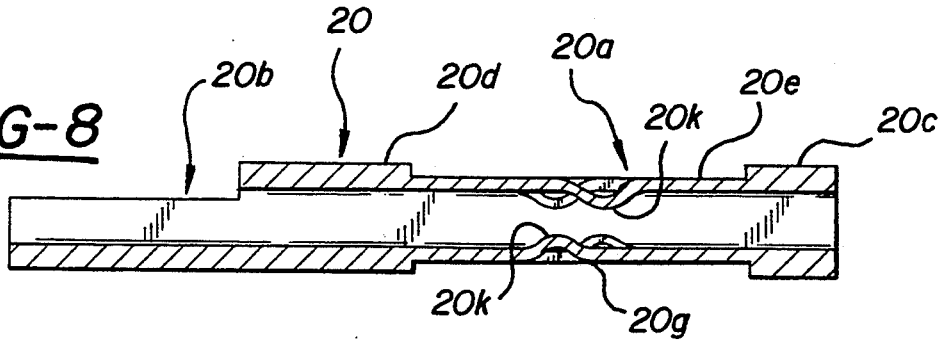

FEMALE BLADE TERMINAL

BACKGROUND OF THE INVENTION

This invention relates to electrical connectors and more particularly to a female blade terminal comprising a part of an electrical connector.

Electrical connectors comprising interengaging male and female terminals are well known in the art and are in wide use for establishing electrical connection between various electrical components. One popular and widely used electrical connector comprises a male blade terminal adapted to be slidably received in a cage or socket defined by a female blade terminal.

There are many design parameters that must be considered when designing a connector of the blade type. Specifically, the connector must have a simple and inexpensive design; must have a relatively small size; must provide maximum current carrying capacity; must provide a low insertion force so as to allow easy connection and disconnection of the terminal elements; must provide sufficient grasping action as between the terminal elements to preclude inadvertent separation of the elements; must provide reliable and consistent operation for sustained periods of time; and must discourage corrosion and contamination of the electrical interface provided by the connector.

Whereas a myriad of electrical connectors of the blade type have been proposed and are in common usage, none of the prior art blade type connectors totally satisfy all of the noted design parameters.

SUMMARY OF THE INVENTION

This invention is directed to the provision of an improved electrical connector of the blade type.

More specifically, this invention is directed to the provision of an electrical connector of the female blade type which is simple and inexpensive, provides maximum current carrying capacity, provides a low insertion force, provides sufficient grasping force to preclude inadvertent separation of the terminal elements, provides reliable, consistent operation over long periods of time, and protects the electrical interface from corrosion and contamination.

The electrical female blade terminal of the invention is formed from a single piece of conductive sheet material of a given thickness and including a front cage structure including a plurality of longitudinally extending parallel beam portions and adapted to slidably receive a male blade terminal, and a rear conductor structure for electrical connection to a further conductive member.

According to the invention, the beam portions have a thickness less than the given thickness of the single piece of conductive sheet material. This arrangement allows the design and parameters of the beam portions to be controlled independently of the design parameters of the remainder of the terminal.

According to a further feature of the invention, the cage portion includes front and rear annular collar portions having the thickness of the single piece of conductive sheet material and the reduced thickness beam portions extend between the annular collar portions. This specific construction allows the behavior of the beam portions to be carefully and specifically controlled.

According to a further feature of the invention, the radially inner surfaces of the beam portions are flush with the radially inner surfaces of the collar portions and the radially outer surfaces of the beam portions are radially recessed with respect to the radially outer surfaces of the collar portions. This specific construction allows further precise control of the insertion behavior of the beam portions.

According to a further feature of the invention, the terminal further includes a tubular shroud adapted to be positioned over the cage structure in surrounding relation to the beam portions. This arrangement allows the shroud to constrain undesired outward splaying of the cage structure and allows the shroud to determine and delimit the extent of outward flexing movement of the beam portions upon insertion of the male blade element.

According to a further feature of the invention, the shroud has a seamless tubular cross-sectional configuration. This specific shroud construction ensures that a seam in the shroud does not coincide with the seam of the cage structure whereby to ensure that the shroud serves its function of precluding outward splaying of the cage structure.

The invention also provides an improved method of forming an electrical female blade terminal. According to the invention methodology, a piece of conductive sheet material of a given thickness is provided having an elongated reduced thickness portion proximate a front end of the piece; a plurality of parallel slits are formed in and extend across the reduced thickness portion to define a plurality of parallel beam portions of reduced thickness extending across the reduced thickness portion; and the front end of the piece is formed into an annular cage structure sized to slidably receive a male blade terminal with the beam portions spaced circumferentially about the cage structure. This methodology provides for the simple and inexpensive formation of a female blade terminal having reduced thickness beam portions in the cage.

According to a further feature of the invention methodology, a shroud of tubular configuration is provided and the shroud is positioned over the cage structure in surrounding relation to the beam portions. In the disclosed embodiment of the invention methodology, the shroud is formed with a seamless tubular cross-sectional configuration so as to ensure that the shroud, when in place over the cage structure, precludes unwanted outward splaying of the cage structure in response to insertion of a male blade terminal.

BRIEF DESCRIPTION OF THE DRAWINGS

FIG. 4 is a view of a stamping utilized to form the female blade terminal;

FIG. 7 is a plan view of a modified form of female blade terminal;

FIG. 8 is a cross-sectional view taken on line 8—8 of FIG. 7;

DETAILED DESCRIPTION OF THE PREFERRED EMBODIMENTS

The electrical female blade terminal assembly seen in FIGS. 1–6, broadly considered, comprises a female blade terminal 10 and a tubular shroud 12.

Female blade terminal 10 is formed from a single piece of conductive sheet material 14 of a given thickness and includes a front cage structure 14*a* and a rear connector structure 14*b*. Piece 14 may comprise, for example, a sheet of beryllium copper or high conductivity phosphate bronze and may have a thickness, for example, of 0.40 mm.

Cage structure 14*a* has a rectangular tubular configuration sized to slidably receive a flat male blade terminal 16 having a cross-sectional configuration generally corresponding to the rectangular tubular configuration of the cage structure.

Cage structure 14*a* includes a front collar portion 14*c*, a rear collar portion 14*d*, and a plurality of beam portions 14*e*, 14*f*, 14*g*, 14*h*, 14*i*, and 14*j*.

Figures 1, 2, 3:
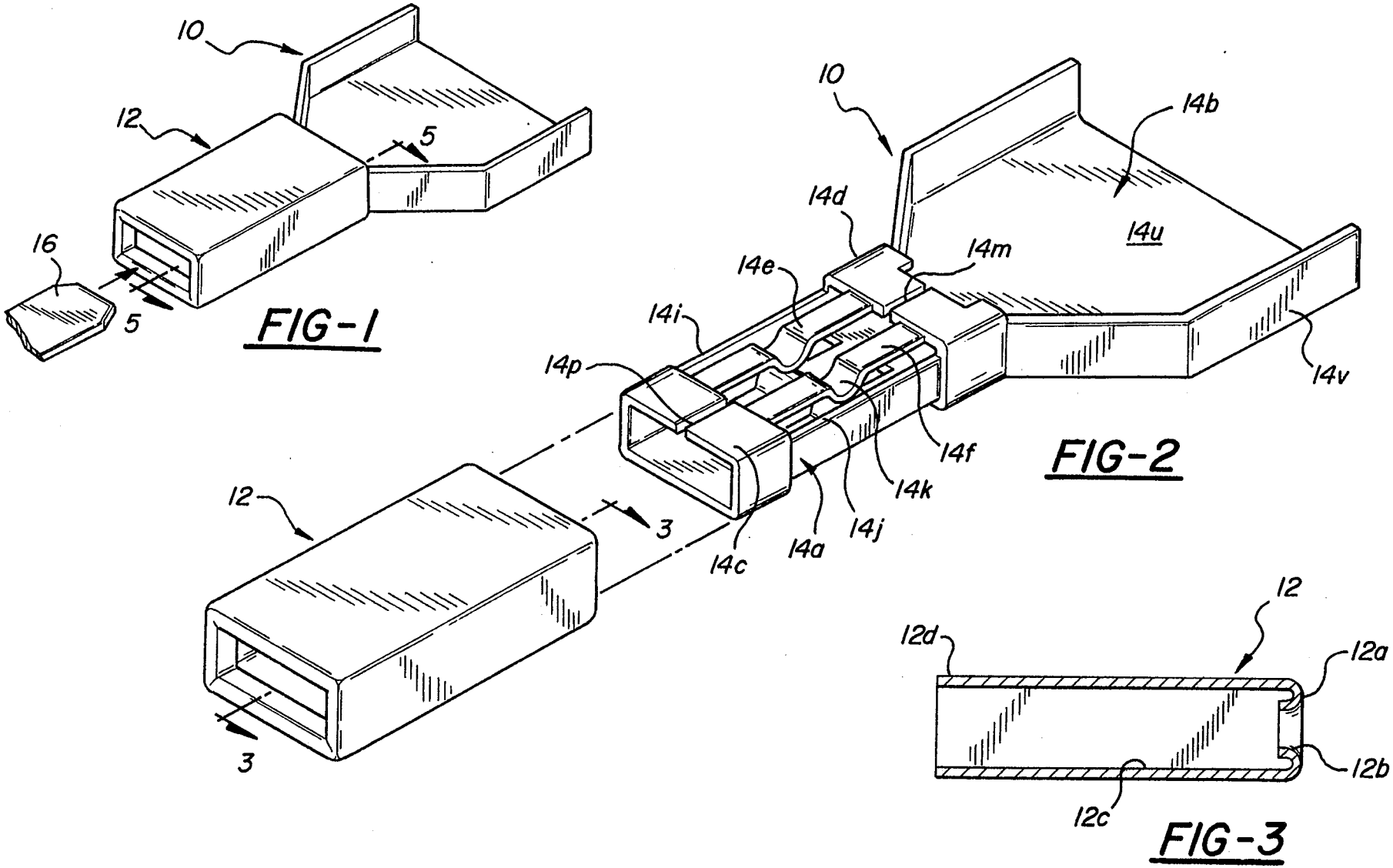
FIG. 1 is a perspective view of a female blade terminal assembly according to the invention.
FIG. 2 is an exploded view on an enlarged scale of the female blade terminal assembly of FIG. 2 showing the female blade terminal and coacting shroud.
FIG. 3 is a cross-sectional view taken on line 3—3 of FIG. 2.

Female blade terminal 10 is shown as a flat stamping in FIG. 4 and in its final formed configuration in FIG. 2.

Beam portions 14*e*–14*j* will be seen to have a reduced thickness as compared to the thickness of the remainder of the terminal piece 14 and may, for example, have a thickness equal to half the thickness of the remainder of the terminal piece 14 so that for a terminal piece 14 having a thickness of 0.40 mm, the beam portions will have a thickness of 0.20 mm. Beam portions 14*e*, 14*g*, 14*h*, and 14*f* will be seen to have a central depressed contact portion 14*k*.

In the final formed configuration of the cage structure as seen in FIG. 2, the opposite end edges 141 of rear collar 14*d* are juxtaposed to form a central seam 14*m*, the opposite end edges 14*n* of front collar portion 14*c* are juxtaposed to form a central seam 14*p*; beam portions 14*i* and 14*j* form vertical side edge walls of the cage structure; beams 14*e* and 14*f* are positioned in parallel relation on one flat face of the cage structure on opposite sides of seams 14*m*, 14*p*; and beams 14*g* and 14*h* are positioned in parallel relation on the opposite flat face of the cage structure in respective confronting relation to beams 14*e* and 14*f*.

It will be seen that the radially inner surfaces 14*q* of the beam portions are flush with the radially inner surfaces 14*r* of the collar portions and the radially outer surfaces 14*s* of the beam portions are radially recessed with respect to the radially outer surfaces 14*t* of the collar portions.

Connector structure 14*b* may take many forms depending upon the envisioned application for the terminal. As shown, connector portion 14*b* includes a base portion 14*u* of flat configuration and upturned lip or edge portions 14*b*. It will be understood that the configuration of connector portion 14*b* is dependent upon the manner in which the female blade terminal is to be connected to the associated conductor member. The illustrated configuration is useful, for example, in fastening the female blade terminal to the side face of a conductor ribbon for use in providing connector assemblies for use in an electrical interface board. Alternatively, and as is well known, connector portions 14*b* may be configured to receive a stripped wire and may include first crimping portions designed to crimpingly receive the bare wire per se and further crimping portions designed to crimpingly receive the insulation for the wire.

Tubular shroud 12 is formed of a suitable conductive material such as copper and has a seamless tubular rectangular cross-sectional configuration generally corresponding to, but somewhat larger than, the cross-sectional configuration of cage structure 14*a*. Shroud 12 may be formed, for example, in an extrusion operation. Shroud 12 may have a nominal wall thickness, for example, of 0.127 mm and, following the extrusion of the basic tubular seamless configuration, is rolled to form a rectangular inturned lip or edge 12*a*. The internal diameter 12*b* of lip 12*a* has a size and configuration matching the size and configuration of the internal diameter formed by the inner surface 14*r* of cage structure 14*a* so that, with the shroud positioned over the cage structure, the annular surface formed at the inner diameter of the lip portion 12*a* of the shroud is flush with the radially inner surface 14*r* of the cage structure.

In the assembled relation of the terminal 14 and the shroud 12, the shroud is fitted over the cage structure 14*a* in surrounding relation to beam portions 14*e*–14*k* with the radially inner surface 12*c* of the shroud seating on the annular seating surfaces defined by the radially outer surfaces 14*t* of front and rear collar portions 14*c* and 14*d*. Shroud 12 may be maintained on the cage structure with a friction fit or, alternatively, the inboard end portion 12*d* of the shroud may be bent over (as seen in dash lines in FIG. 5) to preclude inadvertent lateral displacement of the shroud relative to the cage structure.

Figures 6, 10:
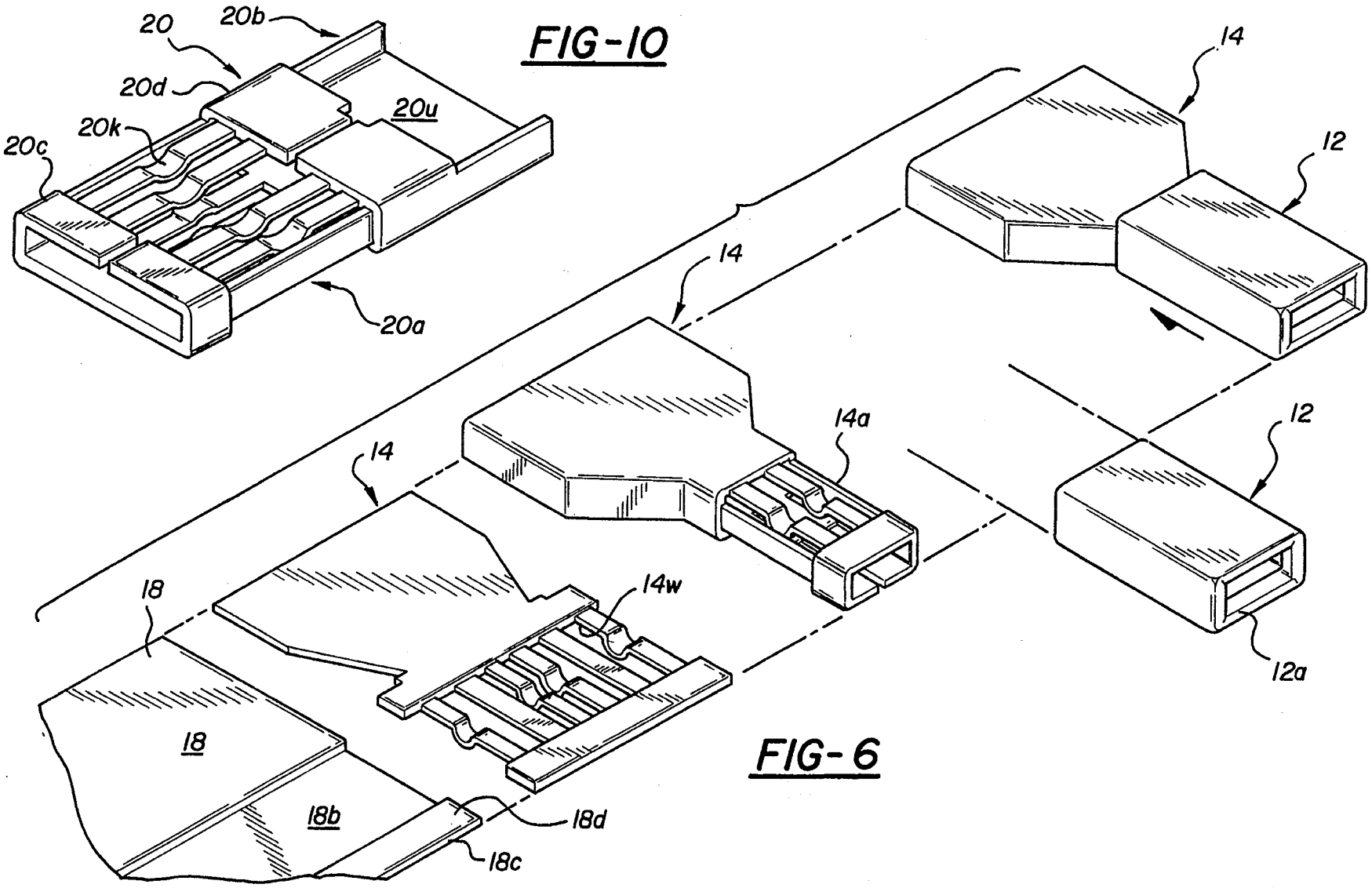
FIG. 6 is a perspective view illustrating the invention methodology.
FIG. 10 is a perspective view of the female blade terminal of FIG. 7.

The methodology for forming the invention electrical female blade terminal is seen in FIG. 6. As seen in FIG. 6, a strip 18 of conductive material such as beryllium copper or high conducting phosphate bronze is provided and includes a main body portion 18*a* of nominal thickness and a strip 18*b* of reduced thickness and spaced from the front edge 18*c* of the piece by a front border portion 18*d* of nominal thickness. A successive series of blanks 14 are formed from the strip 18 utilizing a plurality of swaging and blanking stations including a station at which parallel slits 14*w* are formed in the blank extending across the reduced thickness portion 18*b* to define beam portions 14*e*–14*k* and a further station at which central depressed contact portions 14*k* are formed in beam portions 14*e*, 14*f*, 14*g* and 14*h*; each blank 14 is folded at a plurality of stations to form the final female blade terminal configuration; a plurality of shrouds 12 are formed in an extrusion operation and the ends 12*a* of the shrouds are rolled; and a shroud 12 is fitted over the cage structure 14*a* of each female blade terminal 14 in surrounding relation to the beam portions 14*e*–14*j* to form the final female blade terminal assembly.

Figure 5:
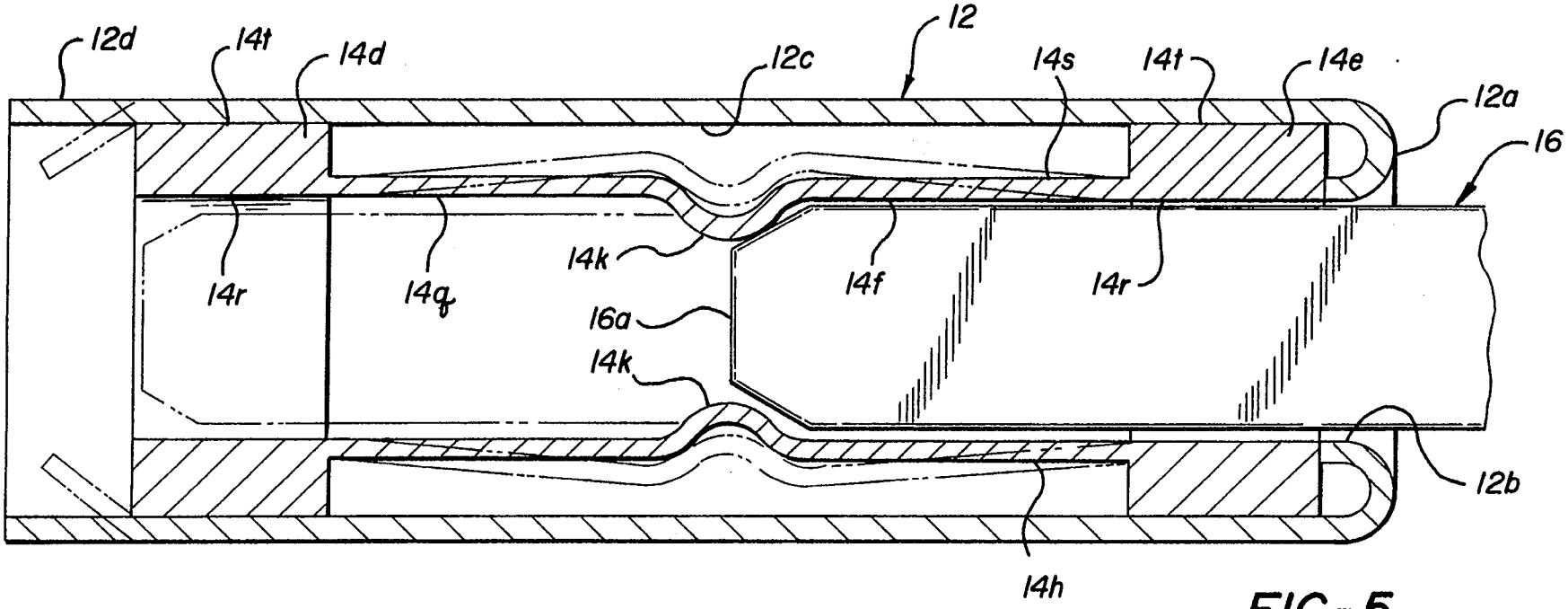
FIG. 5 is a cross-sectional view taken on line 5—5 of FIG. 2.
Figure 9:
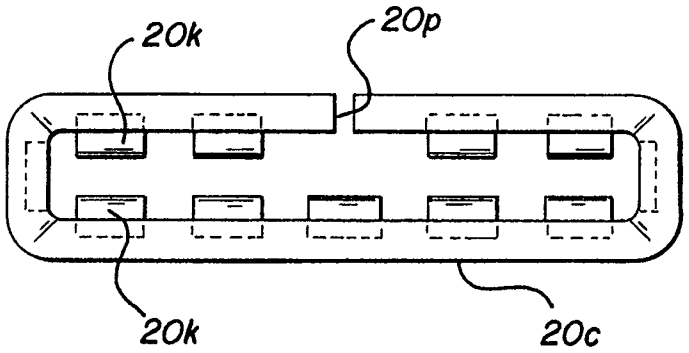
FIG. 9 is an end view of the female blade terminal of FIG. 7.

The operation of the completed female blade terminal assembly is best seen in FIG. 5 wherein a male blade terminal 16 is shown inserted into the socket defined by cage 14*a* for engagement with contacts 14*k* defined on beam portions 14*e*, 14*f*, 14*g* and 14*h*. As the leading or front end 16*a* of the male blade terminal encounters the contacts 14*k* the beam portions are deflected outwardly to the dotted line positions seen in FIG. 5 to allow the male terminal to move to the fully inserted position seen in dash lines in FIG. 5. The thin beam portions deflect to allow the full insertion of the male blade terminal while yet maintaining a firm electrical contact with the male blade terminal.

It will be seen that the reduced thickness of the beam portions, as compared to the collar portions of the cage structure, provides a low spring rate for the beam portions and thereby allows the beam portions to move readily outwardly in response to insertion of the male blade terminal. It will be understood that the elements are dimensioned such that the outwardly displaced position of the beam portions is normally radially inwardly of the inner surface 12*c* of the shroud and that the shroud inner surface 12*c* serves to delimit and define the maximum amount of deflection of the beam portions allowed irrespective of tolerant stack-ups of the various elements. It will further be seen that, since the shroud 12 is seamless, outward splaying of the cage structure 14*a* in response to insertion of the male blade terminal 16, which would result in poor or non-existent electrical contact as between the contacts 14*k* and the male blade terminal, is precluded by the shroud. The shroud also provides a heat sink for the terminal assembly to facilitate cooling of the assembly to maximize the current carrying capacity of the assembly. The shroud also prevents flexing of the beam portions beyond their elastic limit since the inner surface 12*c* of the shroud precludes outward movement of the beam portions to an extent such as would allow the beam portions to take a permanent set. The seamless shroud further provides a seamless cover for the electrical contact as between the contacts 14*k* and the male blade terminal so as to preclude the entry of contaminants into the electrical interface between the contact 14*k* and the male blade terminal.

The female blade terminal 20 seen in FIGS. 7–10 is generally similar to the terminal 14 of FIGS. 1–6 with the exception that the cage structure 20*a* of the female blade terminal 20 is configured to define four beam portions 20*e* on one flat face of the cage structure and five beam portions 20*g* on the opposite flat face of the cage structure; four of the beam portions 20*g* respectively underlie the four beam portions 20*e* with a fifth, central beam portion 20*g* underlying central seams 20*m* and 20*p;* and the contacts 20*k* formed as depressions in the beam portions are selectively longitudinally offset or staggered so that the contact 20*k* of the beam portion 20*e* on one flat face of the cage structure is longitudinally offset with respect to the contact 20*k* of the opposing beam portion 20*g* on the other flat face of the cage structure so as to minimize the force required to insert the male blade terminal 16 into the cage structure. It will be understood that the female blade terminal 20 of FIGS. 7–10 is used in association with a shroud 12 to form a female blade terminal assembly.

The invention female blade terminal assembly will be seen to have many important advantages. Specifically, the terminal structure is simple and inexpensive; the terminal assembly has a relatively small size; the terminal assembly provides maximum current carrying capacity by virtue of the heat sink provided by the shroud; the assembly provides a low insertion force because of the low spring rate of the reduced thickness beam portion; the assembly is reliable and consistent in operation since the cage structure is precluded from splaying outwardly, with resultant derogation of the electrical interface, and since the outward displacement of the beam portions is delimited by the shroud to preclude plastic deformation of the beam portions; and the seamless shroud precludes the entry of contaminants into the electrical interface to preclude derogation of the electrical inter-connection provided at the electrical interface.

Whereas preferred embodiments to the invention have been illustrated and described in detail in will be apparent that various changes may be made in the disclosed embodiments without departing from the scope or spirit of the invention.

What is claimed is:

1. An electrical female blade terminal formed from a single piece of conductive sheet material of a given thickness and including a front cage structure, which includes a plurality of longitudinally extending parallel beam portions and is adapted to slidably receive a male blade terminal, and a rear connector structure for electrical connection to a further conductive member, characterized in that:

the beam portions have a reduced thickness less than said given thickness; and the cage portion includes front and rear annular collar portions of said given thickness with the reduced thickness beam portions extending between the annular collar portions.

2. An electrical female blade terminal according to claim 1 wherein:

the radially inner surfaces of the beam portions are flush with the radially inner surfaces of the collar portions and the radially outer surface of the beam portions are radially recessed with respect to the radially outer surfaces of the collar portions.

3. An electrical female blade terminal formed from a single piece of conductive sheet material of a given thickness and including a front cage structure, which includes a plurality of longitudinally extending parallel beam portions and is adapted to slidably receive a male blade terminal, and a rear connector structure for electrical connection to a further conductive member, characterized in that:

the beam portions have a thickness less than said given thickness; and the female blade terminal further includes a tubular shroud adapted to be positioned over the cage structure in surrounding relation to the beam portions.

4. An electrical terminal according to claim 3, wherein the shroud has a seamless tubular cross-sectional configuration.

5. An electrical female blade terminal assembly including a one piece female blade terminal having a front cage structure portion, which includes a plurality of longitudinally extending parallel beam portions and is adapted to slidably receive a male blade terminal, and a rear connector structure portion for connection to a further conductive member; and a tubular shroud adapted to be positioned over the cage structure portion in direct contact with the front cage structure portion and in surrounding relation to the beam portions; characterized in that:

the shroud has a seamless tubular cross-sectional configuration.

6. An electrical female blade terminal assembly including a female blade terminal having a front cage structure, which includes a plurality of longitudinally extending parallel beam portions and is adapted to slidably receive a male blade terminal, and a rear connector structure for connection to a further conductive member; and a tubular shroud adapted to be positioned over the cage structure in surrounding relation to the beam portions; characterized in that:

the shroud has a seamless tubular cross-sectional configuration; and the cage structure includes front and rear annular collar portions defining front and rear radially outer annular seating surfaces to seat the shroud, the beam portions extend between the collar portions, and the radially outer surfaces of the beam portions are radially recessed with respect to the annular seating surfaces of the collar portions.

7. An electrical female blade terminal assembly according to claim 6 wherein:

the female blade terminal is formed from a single piece of conductive sheet material of a given thickness, the cage collar portions are of said given thickness, and the cage beam portions have a thickness less than said given thickness.

8. An electrical female blade terminal comprising:

a rear connector structure for electrical connection a further conductive member; and a front annular cage structure adapted to slidably receive a male blade terminal and including front and rear annular collar portions and a plurality of parallel, circumferentially spaced beam portions extending longitudinally between the front and rear collar portions, joined integrally to the front and rear collar portions, and having a thickness less than the thickness of the front and rear collar portions.

9. An electrical female blade terminal comprising:

a rear connector structure for electrical connection to a further conductive member; and a front annular cage structure adapted to slidably receive a male blade terminal and including front and rear annular collar portions and a plurality of parallel, circumferentially spaced beam portions extending longitudinally between the collar portions, and having a thickness less than the thickness of the collar portions;

radially inner surfaces of the beam portions being flush with radially inner surfaces of the collar portions and radially outer surfaces of the beam portions being radially recessed with respect to radially outer surfaces of the collar portions.

10. A terminal according to claim 9, in combination with a tubular shroud sized to fit over the cage structure and seat on the radially outer surfaces of the collar portion so that the beam portions are radially recessed with respect to the inner surface of the shroud and may deflect outwardly within the limits established by the shroud in response to insertion of a male blade terminal.

11. A terminal according to claim 10 wherein:

the female blade terminal is formed from a single piece of a conductive sheet material; and the beam portions are formed from a reduced thickness portion of the sheet.

12. A terminal according to claim 11 wherein:

the shroud has a seamless tubular cross-sectional configuration.

13. A method of forming an electrical female blade terminal comprising the steps of:

providing a flat piece of conductive sheet material of a given thickness and having an elongated reduced thickness portion extending transversely of the piece proximate but spaced rearwardly from a front edge of the piece to leave a front end strip of said given thickness;

forming a plurality of longitudinally extending parallel slits in and extending across the reduced thickness portion to define a plurality of parallel longitudinally extending beam portions of reduced thickness extending across the reduced thickness portion; and forming the front end of the piece into an annular cage structure sized to slidably receive a male blade terminal with the front end strip forming an annular collar at the front end of the piece and the reduced thickness beam portions extending rearwardly from the annular collar and spaced circumferentially about the cage structure.

14. A method of forming an electrical female blade terminal comprising the steps of:

providing a piece of conductive sheet material of a given thickness and having an elongated reduced thickness portion extending transversely of the piece proximate a front end of the piece;

forming a plurality of longitudinally extending parallel slits in and extending across the reduced thickness portion to define a plurality of parallel longitudinally extending beam portions of reduced thickness extending across the reduced thickness portion;

forming the front end of the piece into an annular cage structure sized to slidably receive a male blade terminal with the beam portions spaced circumferentially about the cage structure;

providing a shroud of tubular configuration; and positioning the shroud over the cage structure in surrounding relation to the beam portions.

15. A method according to claim 14 wherein:

the shroud is formed with a seamless tubular cross-sectional configuration.

* * * * *